US011692341B2

(12) United States Patent
Wu et al.

(10) Patent No.: US 11,692,341 B2
(45) Date of Patent: Jul. 4, 2023

(54) LIGHTWEIGHT CONCRETE MODULAR INTEGRATED CONSTRUCTION (MIC) SYSTEM

(71) Applicant: Nano and Advanced Materials Institute Limited, Hong Kong (HK)

(72) Inventors: Yanmin Wu, Hong Kong (HK); Juan Zhang, Hong Kong (HK); Yik Fung Lau, Hong Kong (HK); Honggang Zhu, Hong Kong (HK)

(73) Assignee: Nano and Advanced Materials Institute Limited, Hong Kong (HK)

( * ) Notice: Subject to any disclaimer, the term of this patent is extended or adjusted under 35 U.S.C. 154(b) by 0 days.

(21) Appl. No.: 17/380,055

(22) Filed: Jul. 20, 2021

(65) Prior Publication Data

US 2022/0025639 A1 Jan. 27, 2022

Related U.S. Application Data

(60) Provisional application No. 63/103,180, filed on Jul. 22, 2020.

(51) Int. Cl.
*E04B 1/348* (2006.01)
*E04B 1/41* (2006.01)

(52) U.S. Cl.
CPC ..... *E04B 1/34823* (2013.01); *E04B 1/41* (2013.01)

(58) Field of Classification Search
CPC ..... E04B 1/34823; E04B 1/41
(Continued)

(56) References Cited

U.S. PATENT DOCUMENTS 2,312,338 A * 3/1943 Hulme ..... E04B 1/4107 52/710
3,378,971 A * 4/1968 Singer ..... E04B 1/24 52/236.7

(Continued)

FOREIGN PATENT DOCUMENTS

CN 104727439 A 6/2015
CN 105283609 A * 1/2016 ..... B66C 1/16

(Continued)

OTHER PUBLICATIONS

Search Report of Corresponding Hong Kong Short-Term Patent Application No. 32021035383.7 dated Aug. 6, 2021.

(Continued)

*Primary Examiner* — Brian D Mattei
*Assistant Examiner* — Joseph J. Sadlon
(74) *Attorney, Agent, or Firm* — Idea Intellectual Limited; Margaret A. Burke; Sam T. Yip

(57) ABSTRACT

The present invention provides a multi-storey modular building including at least a first and a second lightweight concrete-based prefabricated modules each having at least a beam, a column, and one horizontal structure selected from a ceiling or a floor at least partially attached to two or more of the beams and columns. A connection system includes at least one vertical alignment connector attached to a horizontal load-distributing plate positioned between the first and second lightweight concrete-based prefabricated modules for connecting the first and second lightweight concrete-based prefabricated modules, where a top portion thereof is positioned in a grout accepting cavity in the bottom end of the column of the second lightweight concrete-based prefabricated module and that in the top end of the column of the first lightweight concrete-based prefabri- (Continued)

cated module. In-situ grout embeds the vertical alignment connector in each grout accepting cavity.

10 Claims, 15 Drawing Sheets

(58) Field of Classification Search
USPC ..... 52/79.13
See application file for complete search history.

(56) References Cited

U.S. PATENT DOCUMENTS 3,503,170 A * 3/1970 Shelley ..... E04B 1/34823 D25/4
3,594,971 A * 7/1971 Hughes ..... E04B 1/215 52/432
3,643,390 A * 2/1972 Shelley ..... E04B 1/34823 52/234
3,694,977 A * 10/1972 Verman ..... E04B 1/34823 D25/4
3,714,304 A * 1/1973 Carner et al. ..... F24F 3/0522 264/572
3,742,660 A * 7/1973 Bierweiler ..... E04B 1/34823 D25/4
3,782,061 A * 1/1974 Minutoli ..... E04B 1/06 52/298
3,867,805 A * 2/1975 Mikami ..... E04B 1/215 52/848
3,884,005 A * 5/1975 Wey ..... E04B 1/043 403/294
3,894,373 A * 7/1975 Willingham ..... E04B 1/34823 52/79.14
4,050,215 A * 9/1977 Fisher ..... E04B 1/34815 D25/1
4,136,492 A * 1/1979 Willingham ..... E04B 1/34823 52/79.14
4,194,339 A * 3/1980 Fisher ..... E04B 1/34823 52/79.8
4,398,378 A * 8/1983 Heitzman ..... E04B 1/04 52/251
4,583,336 A * 4/1986 Shelangoskie ..... E04B 1/21 52/250
4,632,346 A * 12/1986 Wilson ..... B63B 35/4406 248/676
5,161,340 A * 11/1992 Wetton ..... E04B 1/21 52/236.7
5,261,198 A 11/1993 McMillan
5,355,642 A * 10/1994 Palamarz ..... E04F 11/1812 52/297
5,367,854 A * 11/1994 Kim ..... E04G 21/06 52/741.1
5,507,124 A * 4/1996 Tadros ..... E04B 5/43 52/251
5,660,020 A * 8/1997 Reay ..... E04B 1/043 52/704
5,845,441 A * 12/1998 Swartz ..... E04B 1/04 52/250
6,223,480 B1 * 5/2001 Khoo ..... B28B 7/02 52/258
6,658,799 B1 * 12/2003 Stoodley ..... E04B 1/34823 52/79.11
7,134,805 B2 * 11/2006 Yee ..... F16L 13/113 52/592.1
7,866,117 B1 * 1/2011 Saebi ..... E04B 1/161 52/309.3
7,941,975 B2 * 5/2011 Ingjaldsdottir ..... E04B 1/3483 52/235
8,074,414 B2 * 12/2011 Carrion ..... E04B 1/34 52/236.7
8,082,710 B2 * 12/2011 Sigurdson ..... E04B 1/04 52/568
8,479,471 B2 * 7/2013 Liberman ..... E04B 1/21 52/742.16
8,800,232 B1 * 8/2014 Keenan ..... E04B 1/41 52/125.4
8,919,058 B2 * 12/2014 Liberman ..... E04B 1/34384 52/79.9
9,267,287 B1 * 2/2016 Bongiorno ..... B66C 1/62
9,347,195 B2 * 5/2016 Whitty, Sr. ..... E02D 27/12
9,416,546 B2 * 8/2016 Claudin ..... E04B 1/003
9,464,436 B2 * 10/2016 Malakauskas ..... E04B 1/35
9,476,218 B2 * 10/2016 Takahashi ..... E04B 1/2403
9,546,044 B2 * 1/2017 Boulton ..... E03B 11/14
9,617,724 B2 * 4/2017 Lubberts ..... E04B 1/04
9,631,359 B2 * 4/2017 Malakauskas ..... E04B 1/34838
10,087,643 B2 * 10/2018 Lubberts ..... E04B 1/4107
10,337,185 B2 * 7/2019 Espinosa ..... E04H 9/021
10,370,844 B2 * 8/2019 Lomax ..... F16M 5/00
10,378,197 B2 * 8/2019 Kurosawa ..... E04B 1/30
10,584,484 B2 3/2020 Cohen
10,718,114 B2 * 7/2020 Park ..... C04B 28/02
10,760,260 B2 * 9/2020 Yin ..... E04B 1/04
10,895,071 B2 * 1/2021 Rutledge ..... E04B 5/14
11,174,630 B2 * 11/2021 Bowron ..... E04B 1/34838
11,401,707 B2 * 8/2022 Zhou ..... E04B 1/043
11,542,719 B2 * 1/2023 Chen ..... E04B 1/043
2008/0163567 A1 * 7/2008 Jordan ..... E04H 9/145 52/122.1
2010/0024323 A1 * 2/2010 Huang ..... E04B 1/24 52/745.05
2010/0083590 A1 * 4/2010 Wochnik ..... E04C 2/041 52/79.1

FOREIGN PATENT DOCUMENTS

CN 106703292 A 5/2017
CN 107882179 A 4/2018
CN 108779634 A 11/2018
CN 109689987 A 4/2019
CN 110005069 A 7/2019
CN 110878587 A 3/2020
GB 1027241 A 4/1966
JP 2016532030 A 10/2016
WO 2010151539 A1 12/2010
WO WO-2014017931 A1 * 1/2014 ..... E04B 1/34823
WO WO-2017146836 A1 * 8/2017 ..... E04B 1/1909
WO 2020038871 A1 2/2020

OTHER PUBLICATIONS

Office Action of corresponding China Patent Application No. 202110833670.1 dated Oct. 8, 2022.

* cited by examiner

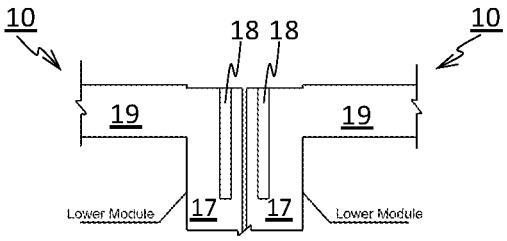
FIG. 18A
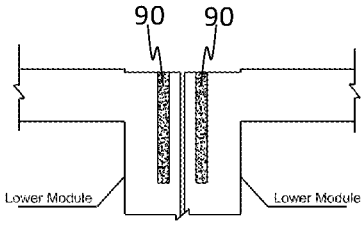
FIG. 18B
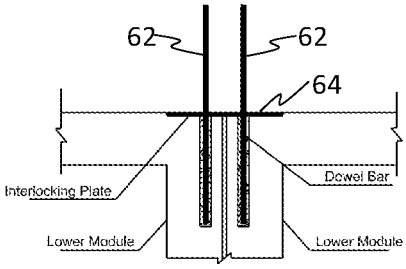
FIG. 18C
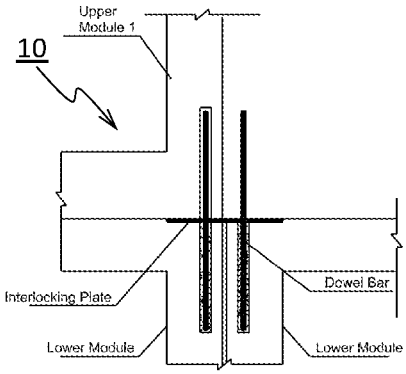
FIG. 18D
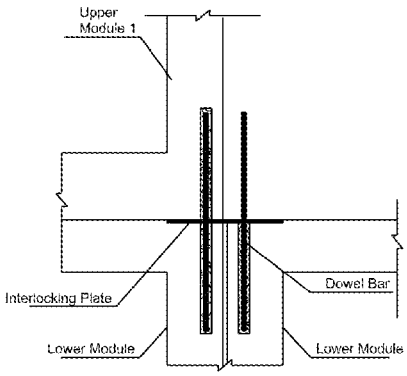
FIG. 18E
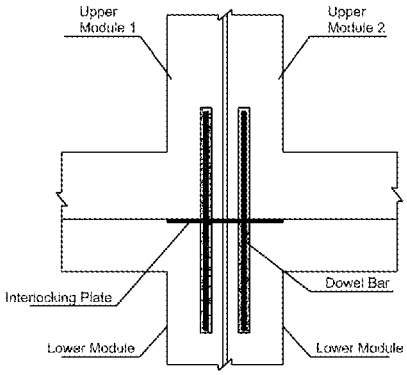
FIG. 18F
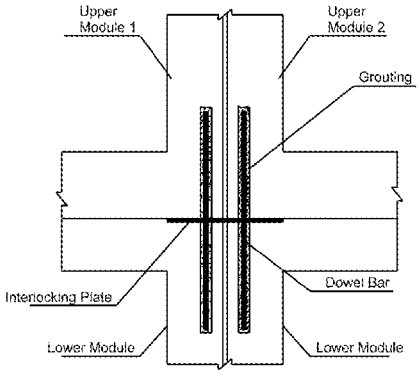
FIG. 18G
FIG. 18

LIGHTWEIGHT CONCRETE MODULAR INTEGRATED CONSTRUCTION (MIC) SYSTEM

CROSS-REFERENCE TO RELATED APPLICAATIONS

This application claims priority from a U.S. provisional patent application No. 63/103,180 filed Jul. 22, 2020, and the disclosure of which is incorporated herein by reference in its entirety.

FIELD OF THE INVENTION

The present invention relates to modular integrated construction. The invention relates to construction from prefabricated modules, such as Modular Integrated Construction (MIC)/Prefabricated Prefinished Volumetric Construction (PPVC) and, more particularly, to interconnection between prefabricated modules used to construct multi-storey buildings.

BACKGROUND OF THE INVENTION

High-rise buildings are typically built one level at a time by traditional construction methods, which follow a linear construction sequence on site. Substantial casting of concrete occurs on-site which is subject to external factors such as weather conditions, available manpower, and availability of knowledgeable workers. In addition, the internal finishing of each floor, for example electrical and hydraulic systems, can only be performed after construction of the building. These interior finishes are difficult to complete in the on-site environment.

Modular integrated construction (MiC) is an innovative construction technique that uses free-standing volumetric modules fitted with internal finishes, fittings and fixtures. Typically, the prefabricated modules represent a unit of a building, such as a flat, apartment, office, or a portion thereof, optionally formed complete with plumbing fixtures, electrical wiring, built-in cabinets, etc. The prefabricated modules may include up to four vertical walls and a ceiling and floor; alternatively, they may have fewer than four walls and only a ceiling or floor with the third and/or fourth wall and either ceiling or floor being provided by an adjacent module These modules are prefabricated off-site in a factory prior to transportation to a construction site where they are assembled into multi-storey buildings. By using MiC construction techniques, buildings can be assembled in a shorter period of time with better quality control, fewer workers, and a reduction in construction waste. Additionally, MiC results in reduced building costs and a safer work environment.

Concrete MiC has been adopted in an increasing number of residential building projects and is becoming the trend for high-rise private residential buildings because of the similar touch and feel as conventional reinforced concrete building construction and its merits of reduced inspection and maintenance costs after completion of the buildings.

However, the heavy weight of normal concrete MiC and load limit of tower cranes currently in service give rise to limitations to the dimensions of building modules. In addition, the current concrete MiC usually involves a shear wall structural system which is used to provide stiff resistance to vertical and lateral forces acting in its plane and is capable of transferring loads vertically to a building's foundation, which results in the inflexibility of usage space and architectural layout since the structural shear walls cannot be demolished or removed.

Another problem with concrete MiC is the tedious and large wet trade work on site due to the existing connection joint design by lapping rebars and on-site concrete between modules, or by semi-precast slab, semi wall lapping rebars and on-site concrete to pockets.

Several techniques exist to join prefabricated modules together. Typically, mechanical solutions are employed, for example, a pin from one module being inserted into a mating recess or socket or horizontal and vertical plates bolted to the modules and interconnected with each other. These are commonly used for steel-based modules. Newer connection techniques have also been proposed. For example, WO 2017/058117 uses a module-joining technique involving a retainer, fastener, and link plate. WO 2018/101891 depicts interlocking plates for steel-framed PPVC modules. SG 10201703972W describes a technique for making composite structural walls in PPVC construction in which channels formed in a pair of wall channels receive a linking rod. U.S. Pat. No. 9,366,020 uses a steel frame with a central rod and nut and bolt connection for module assembly.

While these techniques may be acceptable for some environments, locations that are subject to extreme conditions such as high winds (typhoons, hurricanes) or earthquakes may require greater strength in the joints between adjacent prefabricated modules. Further, many prior art joining techniques are directed to steel-framed based modules rather than concrete-based modules. Thus, there is a need in the art for high-strength connections in modular construction to accommodate the needs of buildings subject to potentially harsh environments. Further, there is a need in the art for joining systems for concrete-based MiC modules that are simple to implement on-site and result in secure joining of adjacent modules.

SUMMARY OF THE INVENTION

In a first aspect, the present invention provides a multi-storey modular building made from plural concrete-based prefabricated modules. The building includes a first lightweight concrete-based prefabricated module having at least four concrete load-bearing elements including at least one beam and at least one column. The module also includes at least one horizontal structure selected from a ceiling or a floor that is at least partially attached to two or more of the load-bearing elements. The column has a grout-accepting cavity at its top end. A second lightweight concrete-based prefabricated module is positioned over the first module and includes at least four concrete load-bearing elements including at least one beam and at least one column. At least one horizontal structure selected from a ceiling or a floor is at least partially attached to two or more of the load-bearing elements. The column has a grout-accepting cavity at its bottom end. A connection system connects the first lightweight concrete-based prefabricated module and the second concrete-based prefabricated module, and includes at least one vertical alignment connector attached to a horizontal load-distributing plate, a top portion of the vertical alignment connector positioned in the grout accepting cavity in the bottom end of the column of the second lightweight concrete-based prefabricated module and in the top end of the column of the first lightweight concrete-based prefabricated module. The horizontal load-distributing plate is positioned between the first and second lightweight concrete-based prefabricated modules. In-situ grout embeds the vertical alignment connector in each grout accepting cavity.

In one embodiment of the first aspect, one horizontal load-distributing plate is attached with two vertical alignment connectors for connecting four lightweight concrete-based prefabricated modules of the multi-storey modular building, where two of the four lightweight concrete-based prefabricated modules are upper lightweight concrete-based prefabricated modules and the other two of the four lightweight concrete-based prefabricated modules are lower lightweight concrete-based prefabricated modules, and where each of the upper and lower lightweight concrete-based prefabricated modules is positioned adjacent to the other of the upper and lower lightweight concrete-based prefabricated modules, respectively.

In another embodiment of the first aspect, one horizontal load-distributing plate is attached with four vertical alignment connectors for connecting eight lightweight concrete-based prefabricated modules of the multi-storey modular building building, where four of the eight lightweight concrete-based prefabricated modules are upper lightweight concrete-based prefabricated modules and the other four of the eight lightweight concrete-based prefabricated modules are lower lightweight concrete-based prefabricated modules, and where each of the upper and lower lightweight concrete-based prefabricated modules is positioned adjacent to each of the other three upper and each of the other three lower lightweight concrete-based prefabricated modules, respectively.

In other embodiment of the first aspect, each of the vertical alignment connectors is a steel bar and the horizontal load-distributing plate is a steel plate, where one or more of the steel bars is/are permanently affixed to the steel plate through welding or through mechanical connectors, and where the mechanical connectors may be composed of a threaded portion on the one or more steel bars and a corresponding threaded aperture in the steel plate for receiving the threaded portion of the steel bars.

In yet another embodiment of the first aspect, each of the upper lightweight concrete-based prefabricated modules comprises at least one grouting channel that leads to an upper portion of the grout accepting cavity for grouting to embed the vertical alignment connector in said grout accepting cavity.

In a second aspect, the present invention provides a method of assembling a multi-storey modular building that is made from concrete-based prefabricated modules. In this method, a first lightweight concrete-based prefabricated module is positioned on a first level, the module having at least four concrete load-bearing elements including at least one beam and at least one column, and at least one horizontal structure selected from a ceiling or a floor that is at least partially attached to two or more of the load-bearing elements. The column has a grout-accepting cavity at its top end. Grout is applied to the grout-accepting cavity. A vertical alignment connector attached to a horizontal load-distributing plate is positioned on the first module such that bottom portion of the vertical alignment connector is inserted into the grout-accepting cavity in the top end of the column with the horizontal load-distributing plate positioned over the top end of the column. A second lightweight concrete-based prefabricated module is positioned over the first lightweight concrete-based prefabricated module, the second lightweight concrete-based prefabricated module having a similar column with a grout-accepting cavity at its bottom end. The second lightweight concrete-based prefabricated module is positioned such that a top end of the vertical alignment connector is inserted into the grout-accepting cavity at the bottom end of the column and the horizontal load-distributing plate is positioned between the first and second lightweight concrete-based prefabricated modules.

BRIEF DESCRIPTION OF THE DRAWINGS

Preferred embodiments of the invention are hereafter described, by way of non-limiting example only, with reference to the following drawings in which:

FIGS. 18A-18G illustrates the installation procedure of building modules by using the grouted dowel bars connection joint.

DETAILED DESCRIPTION

Figure 1:
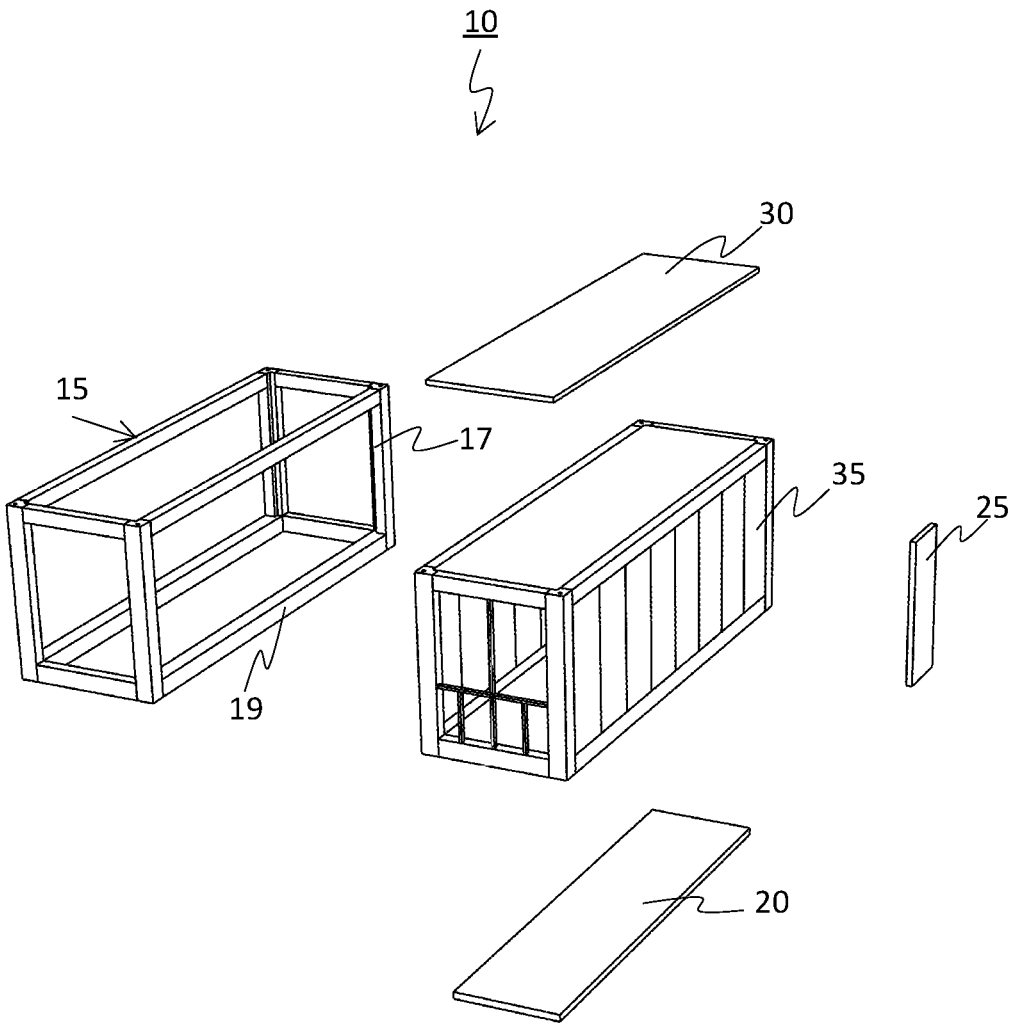
FIG. 1 is a typical MiC module with major components: concrete frame, floor slab, wall panels and ceiling slab.

FIG. 1 depicts a lightweight concrete module for MiC multi-storey buildings according to an embodiment of the present invention. As used herein, the term "lightweight concrete" means concrete that is generally below a density of 2000 kg/m$^3$. The lightweight concrete used in the MiC system of the present invention may be selected from various types, including cellular concrete, foamed concrete or lightweight aggregated concrete. The formulation of lightweight concrete could be adjusted to achieve different compressive strength to meet different building requirements and/or standard.

MiC module 10 typically includes four or more load-bearing columns and beams, a light-weight concrete slab for a floor and a roof, and light-weight concrete non-structural external walls and inside partition walls.

As seen in FIG. 1, the module 10 of the present invention includes high strength concrete (e.g., normal density concrete) column-beam frame 15 coupled with a light-weight concrete floor slab 20 and a light-weight concrete ceiling slab 30. Non-structural light-weight concrete wall panels 25 form perimeter walls 35 and interior partition walls. MiC module which comprises four or more load-bearing columns and beams, light-weight concrete slab for a floor and a roof, and light-weight concrete non-structural external walls and inside partition walls.

The adoption of light-weight concrete slab for floor, ceiling and wall panels in the present invention greatly reduces the total weight of the concrete module and increases its resistance to fire. For the same width (2.5 m) and height (3 m) with a module weight limit of less than 25 tons, the length of a concrete module according to the present invention can be increased from 5 m~6 m to 8 m~10 m. The great weight reduction of the superstructure of an MiC building also helps to realize tremendous savings in its foundation cost. In addition, the provision of a high-strength concrete frame instead of structural load bearing wall system improves the flexibility of space and architectural layout since non-structural light-weight concrete wall panels in the middle area can be demolished or removed.

Figure 2:
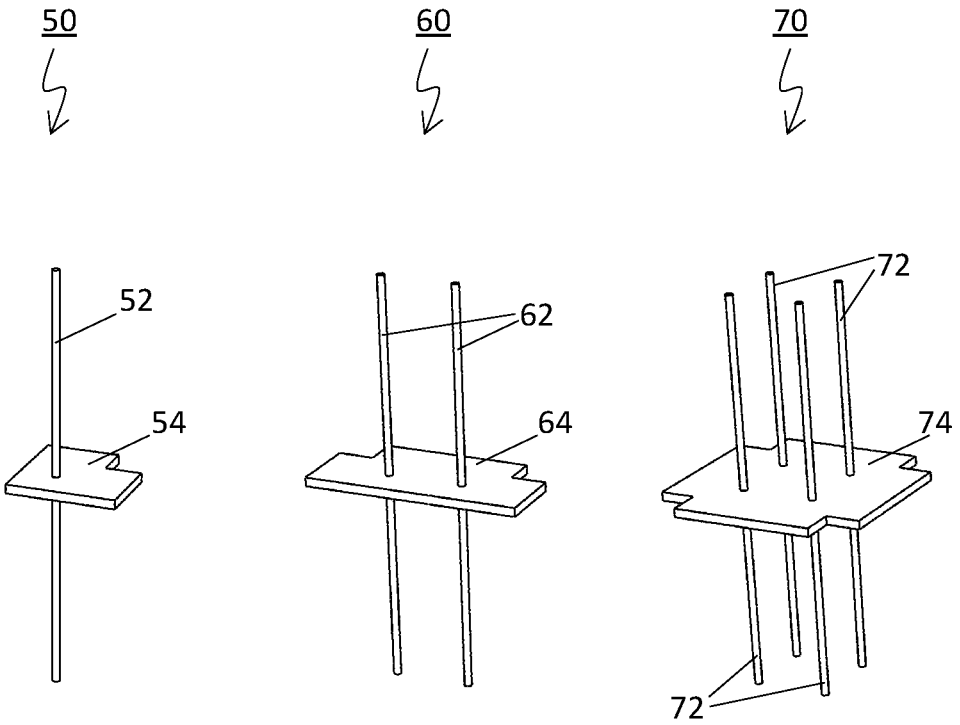
FIG. 2 is different types of interlocking plate with prewelded dowel bars for 1-module, 2-module and 4-module connections.

FIG. 2 depicts a connection system used with the module 10 of FIG. 1. In FIG. 2, a connection system 50 is used to join one lower module 10 and one upper module 10. As will be discussed in further detail below, the connection system 50 includes a vertical alignment connector 52 and a horizontal load-distributing plate 54. The connection system 60 is used to join two lower modules 10 and two upper modules 10 and includes two vertical alignment connectors 62 and a horizontal load-distributing plate 64. The connection system 70 is used to join four lower modules 10 and four upper modules 10 and includes four vertical alignment connectors 72 and a horizontal load-distributing plate 74. Steel bars such as steel dowel bars may be used as the vertical alignment connectors and steel plates may be used as the horizontal load-distributing plates. In an embodiment, the steel dowel bars may be permanently affixed to the horizontal load-distributing plates through welding or through mechanical connectors. For example, the dowel bars may optionally be threaded dowel bars with threaded apertures in the plates to receive the threaded dowel bars.

Advantageously, the connection system of the present invention does not require mechanical elements such as nuts and bolts to secure the connectors. This is important so that the connection system is flush with the interface between modules. Advantageously, the thickness of the horizontal load-distributing plate used may be selected on the job site to accommodate any gaps between adjacent modules due to fabrication variations.

Figure 3:
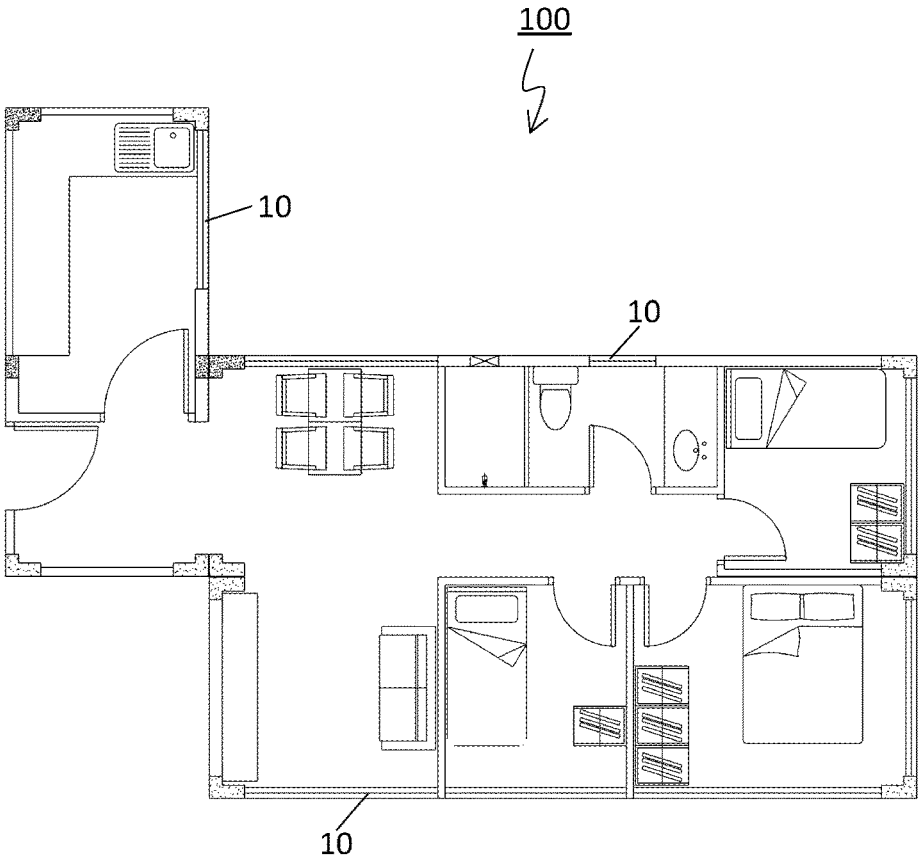
FIG. 3 is a plan view of a flat constructed from three MiC modules.
Figure 4A:
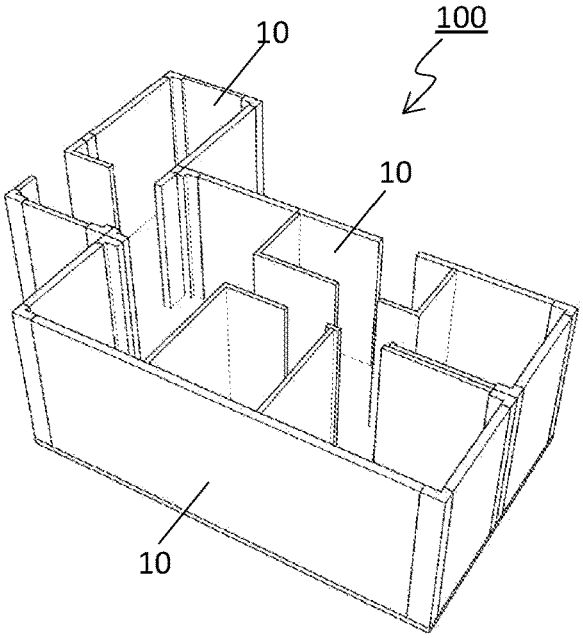
FIG. 4A is a perspective view of the interior of a flat constructed from three MiC modules.
Figure 4B:
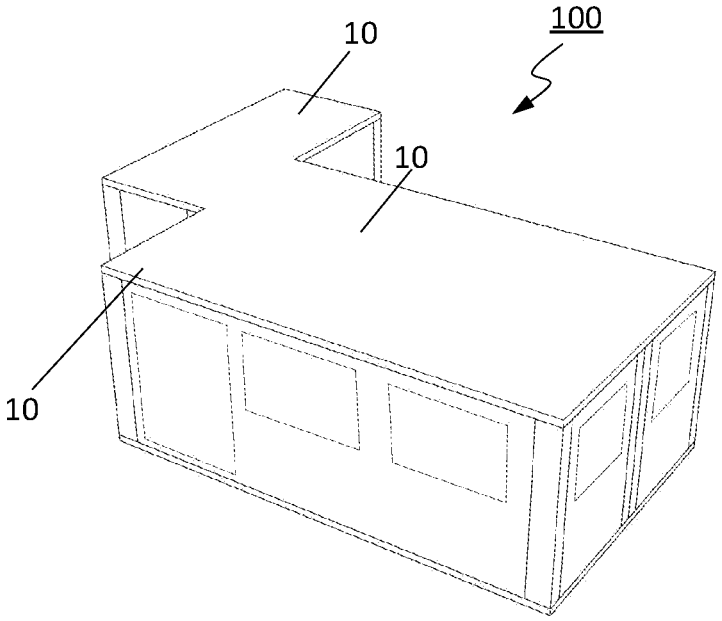
FIG. 4B is a perspective view of a flat constructed from three MiC modules.

FIG. 3 is a plan view of an apartment/flat and FIGS. 4A, and 4B are perspective views of an apartment/flat 100 that is constructed using modular integrated construction modules 10 in accordance with an embodiment of the invention. In the example shown, three concrete MiC modules 10 are coupled together to form the flat in a side by side configuration, which includes three bedrooms, a common bathroom, a kitchen and a living room. However, it is anticipated that a building could include any suitable number and configuration of modules according to the embodiments of the invention.

Figure 4C:
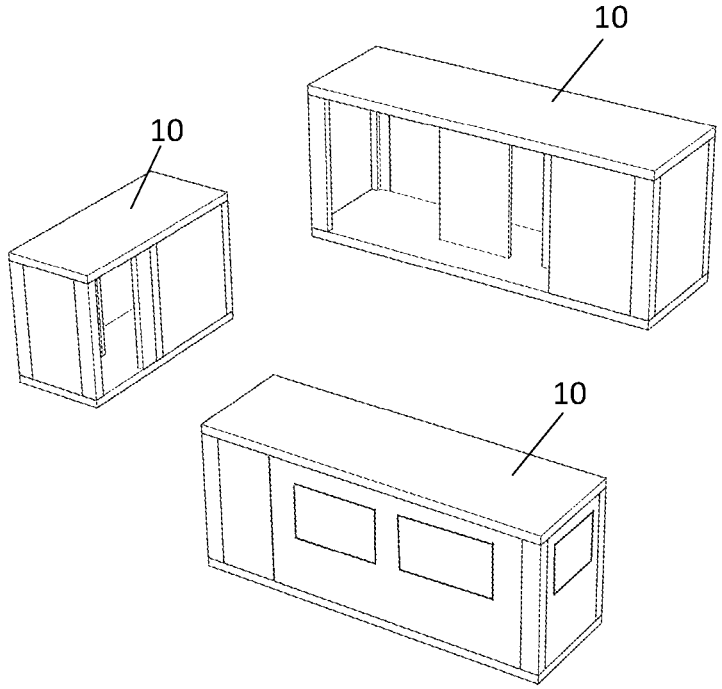
FIG. 4C is a perspective view of the three MiC modules comprising a flat.

FIG. 4C shows the individual modules 10 that make up apartment/flat 100; each module includes a high-strength concrete column-beam frame, light-weight concrete floor and ceiling slabs, and non-structural light-weight concrete wall panels to form perimeter walls and interior partition walls. Note that the use of the non-structural light-weight concrete wall panels allows considerable flexibility in locating doors, and windows which permits the individual apartment/flat to be customized according to user preferences.

Figure 5:
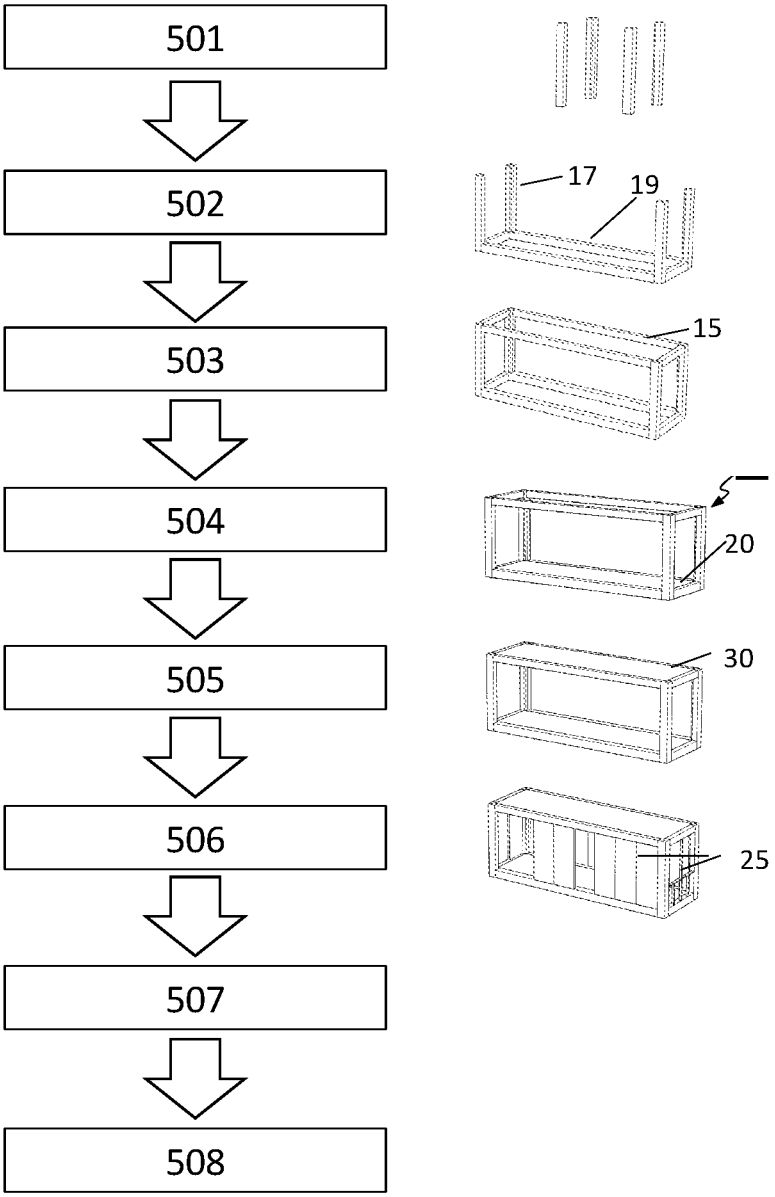
FIG. 5 is the fabrication procedure of a concrete MiC module

FIG. 5 depicts a method that may be used to assemble an individual module according to the present invention. Individual module elements such as columns, beams, slabs, and panels are cast to form precast elements (501). The columns 17 are positioned along with beams 19 (502). In 502, reinforcing steel bars (so-called "re-bars") are positioned, in order to create frame 15 (503) where ceiling beams 19 have also been assembled/poured with re-bar reinforcement. In 503, concreting of beam/column joints also occurs. The floor slab 20 is assembled in module 10 (504), followed by adding ceiling slab 30 (505). Wall panels 25 are then added (506). Interior fittings is then added (507). In some embodiments, electrical, plumbing, HVAC ducts, built-ins such as kitchen cabinets, etc. are added such that the module is completely "move-in ready" while in other embodiments, fewer finishes are added such that a layer user of the space customizes the finishes to his/her preferences. Finally, the module is readied for delivery (508), including optional protective packaging, as needed.

Following delivery of the completed modules to the building site, the modules are assembled together using the connection system of FIG. 2. Because the connection system of FIG. 2 includes few elements and is of low complexity, the system eliminates prior art difficulties in aligning re-bar among modules and extensive concreting work required. As a result, relatively lower-skilled labor may be used for building assembly and a more robust construction method is achieved.

FIGS. 18A-18G demonstrates the assembly of connection system 60 (FIG. 2) to join four modules 10, two upper modules, and two lower modules. FIGS. 18A-18G are described in connection with FIG. 6 which shows four assembled modules 10 using connection system 60 of FIG. 2.

In FIG. 18A, two bottom modules 10 are hoisted into place by a crane and positioned and aligned horizontally to provide a first MiC module level. Note that in the upper surface of each of columns 17 are openings leading to cavities 18. Cavities 18 are configured to receive the vertical alignment connectors 62.

In FIG. 18B, a high-strength, high-flow grout is applied to each of the cavities 18. Optionally, the grout is also a non-shrink grout.

In FIG. 18C, the connector system 60 is inserted such that the vertical alignment connectors 62 are positioned within the grout-containing cavities 18 and the horizontal load-distributing plate 64 is positioned flush with a top surface of columns 17 and optionally extending across a portion of horizontal ceiling beams 19. In this manner, the vertical alignment connectors are self-aligned through the contribution of grout-filled cavities 18 and horizontal load-distributing plate 19. The horizontal load-distributing plate will be maintained in its position due to the vertical forces due to the weight of the upper modules.

In FIG. 18D, a first upper module 10 is hoisted into position by a crane and lowered over one of the vertical alignment connectors 62. The bottom of column 17 of the upper module is similarly provided with a cavity 18 for receiving the vertical alignment connectors.

In FIG. 18E, grout is applied to upper cavity 18; the grout may be injected through a grouting channel that leads to upper cavity 18 (not visible in FIG. 18E). Such channels are themselves closed with grout following the grouting procedure.

In FIG. 18F, a second upper module 10 is hoisted into position by a crane and lowered over the remaining vertical alignment connector 62.

In FIG. 18G, grout is applied to upper cavity 18 through optional grouting channels.

Figure 6:
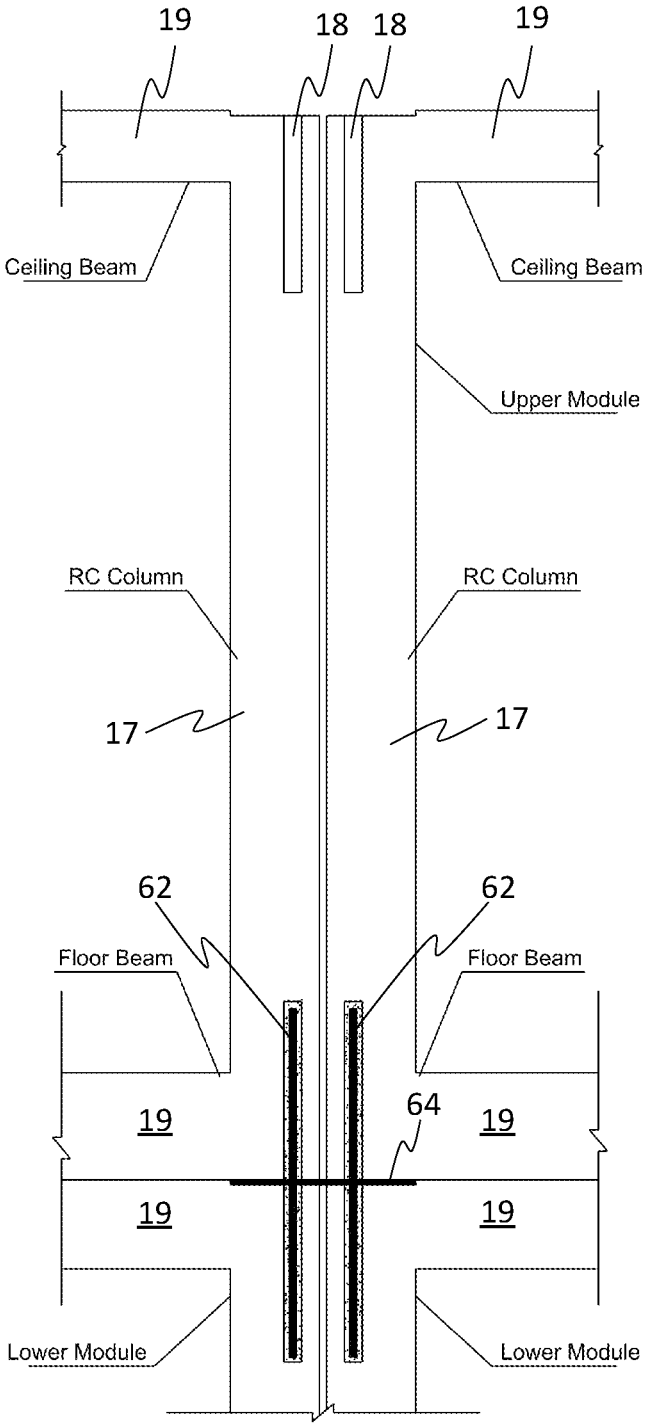
FIG. 6 is a section view of two L-shape columns connected together by an interlocking plate and grouted dowel bars in columns (one dowel bar in each of column)

The completed MiC module-connection system 60 combination is depicted in cross-section in FIG. 6. A plurality of MiC modules 10 with L-shape reinforced concrete columns 19 are connected together both horizontally and vertically with by the grouted vertical alignment connectors 62 and interlocking horizontal load-distributing plate 64. As seen in FIG. 6, there is a cavity 18 at each end of a column of the MiC modules. The cavity may be aligned vertically along a length of the column. The vertical alignment connector 62 thus passes through both a lower and upper MiC module.

Figure 7:
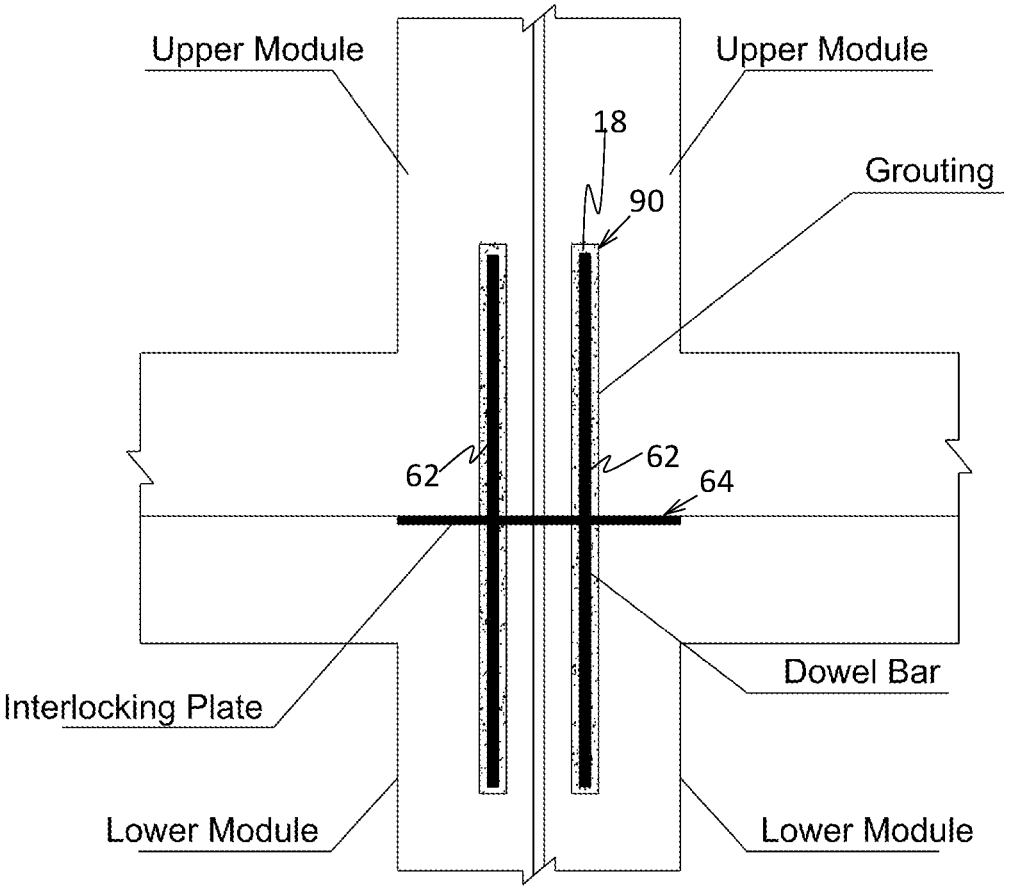
FIG. 7 is an enlarged section view of two L-shape columns connected together by an interlocking plate and grouted dowel bars in columns (one dowel bar in each of column)

FIG. 7 depicts shows an enlarged section view of the connection joints of the four MiC modules connected together horizontally and vertically as shown in FIGS. 6 and 18A-18G in order to explain the load distribution of the novel connection system. The vertical alignment connectors 62 are configured to bear tensile loads and transfer the tensile loads from the upper columns to the lower columns and finally down to a foundation of the building through the grouting 90. The grout may be non-shrink high strength grout. The horizontal load-distributing plate 64 is connected to vertical alignment connectors 62 (e.g., through welding or mechanical connection) and acts as a lateral restraint. It bears and transfers shear forces and compressive forces due to the gravity load and wind load according to national and/or international standards/codes.

As will be seen in further aspects of the present invention, below, the connection system of the present invention is flexible such that it can be used for a number of different module configurations and can also be used to connect different number of modules-two, three, or four modules in a single horizontal lower level with similar numbers of modules in the upper level.

Figure 8:
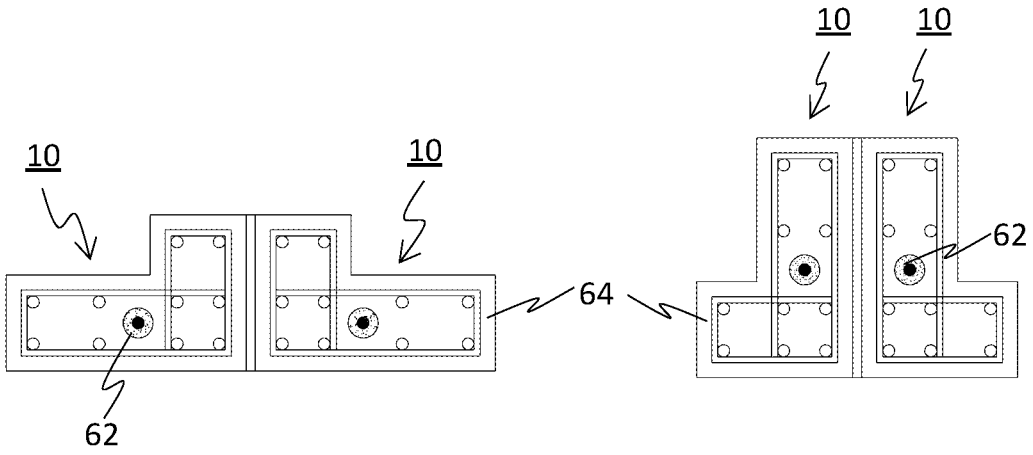
FIG. 8 is a plan view of two L-shape columns connected together by an interlocking plate and grouted dowel bars in columns (one dowel bar in each of column)

FIG. 8 shows the plan views of two L-shape reinforced concrete columns connected together with a grouted vertical alignment connector 52 in each column and a horizontal load-distributing plate 54 for two different arrangements of the column layout. The thickness of the interlocking plate can be varied to accommodate the variation in height due to fabrication error and installation tolerance. The diameter of the cavity provided in a column is preferred at least 3 times of that of the dowel bar used as the connector to ensure the quality of a grouting after the dowel bars are positioned. To ensure the horizontal structural continuity, the diameter of the dowel bars is preferably no more than 2 mm smaller than the inner face of the circular openings of the horizontal interlocking plate. The longitudinal reinforcement and shear links shown in FIG. 8 are indicative and for reference only. They can be arranged according to actual design of the columns in a practical project.

Figure 9:
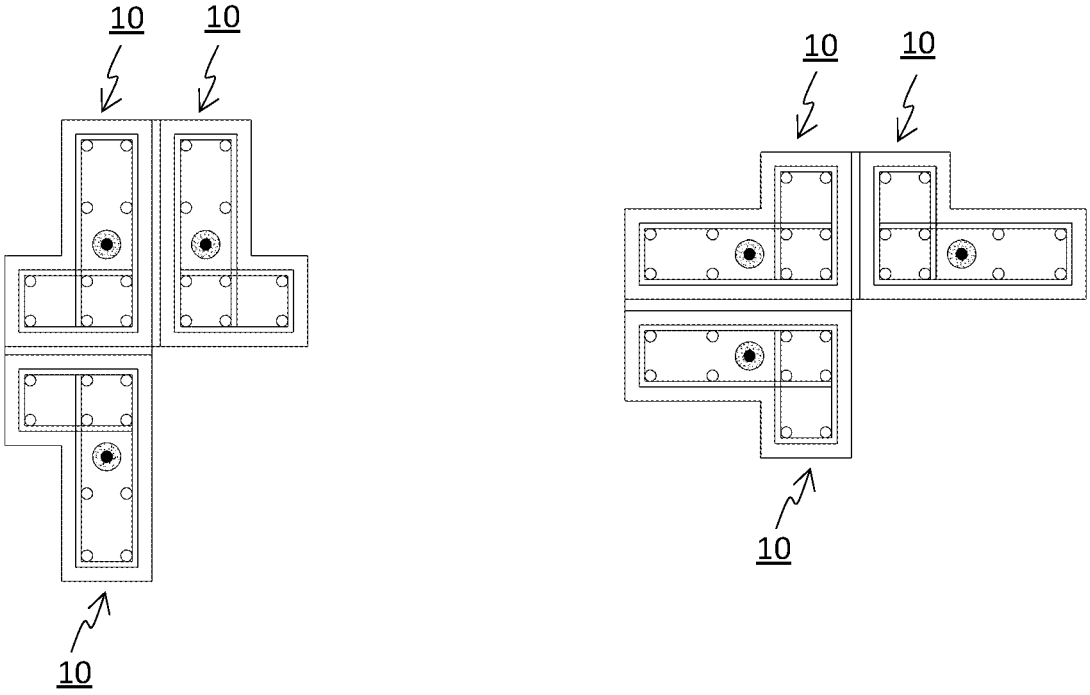
FIG. 9 is a plan view of three L-shape columns connected together by an interlocking plate and grouted dowel bars in columns (one dowel bars in each of column)
Figure 10:
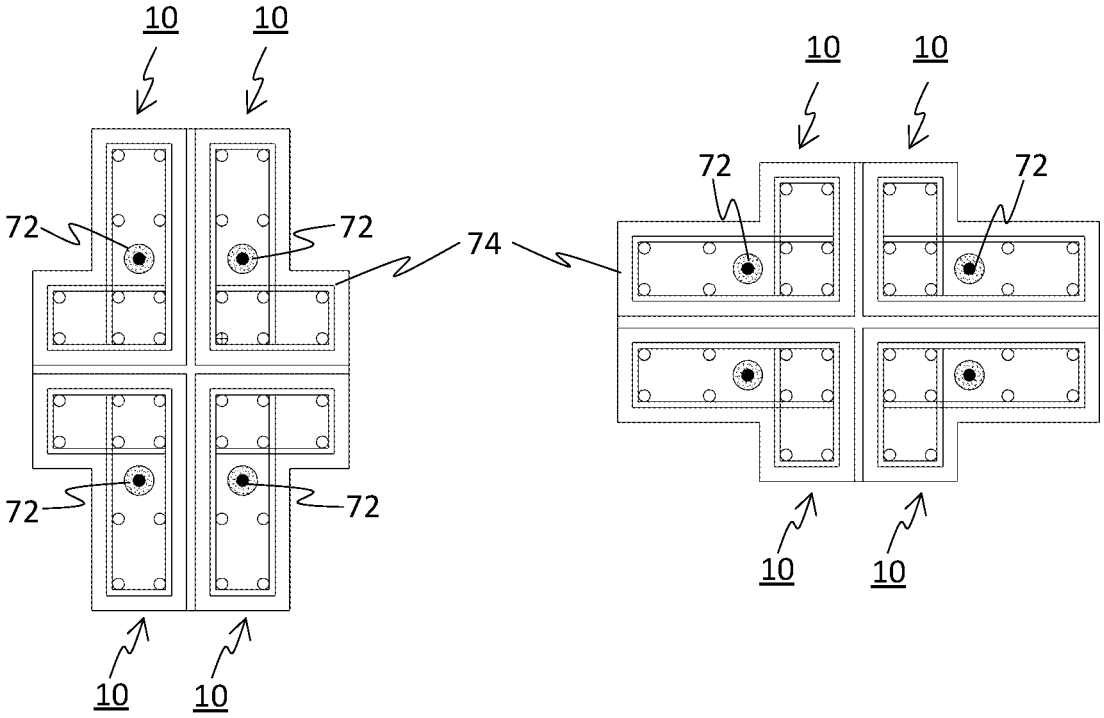
FIG. 10 is a plan view of four L-shape columns connected together by an interlocking plate and grouted dowel bars in columns (one dowel bars in each of column)
Figure 11:
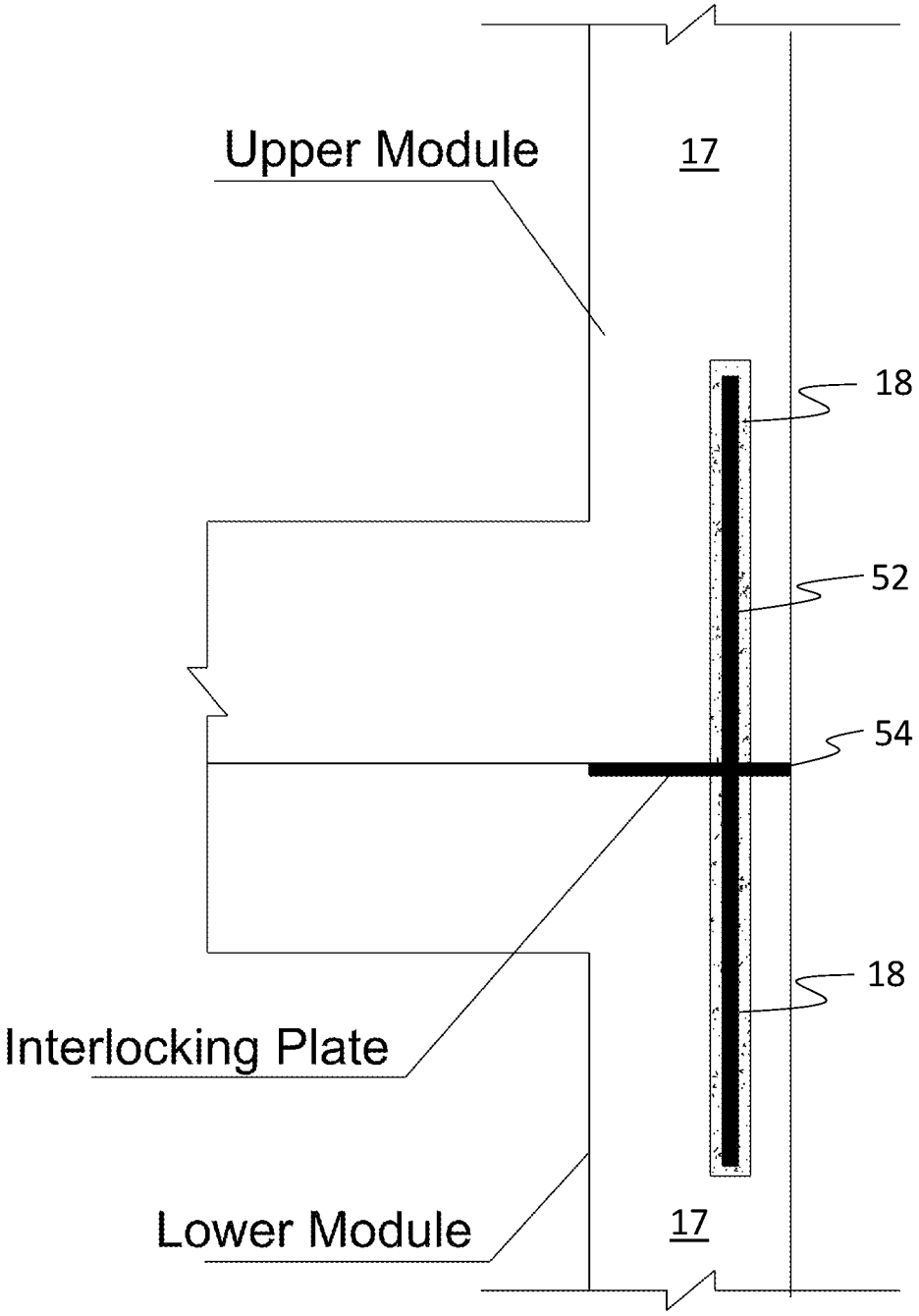
FIG. 11 is an elevation view of corner L-shape columns connected together by an interlocking plate and grouted dowel bars in columns (one dowel bar in each of column)

FIGS. 9, 10 and 11 show the alternative embodiments of the connection system in a top view with the following configurations:

The connection system shown in FIG. 9 connects three MiC modules together horizontally (with three additional modules to be placed vertically).

The connection system 70 shown in FIG. 10 connects four MiC modules together horizontally via plate 74; vertical connector 72 is shown.

The connection system shown in FIG. 11 connects one MiC lower module vertically to one upper MiC module. FIG. 11 depicts the system in a section view showing L-shape reinforced concrete columns connected together horizontally and vertically with an embodiment of the invention by using two grouted dowel bars in each column and an interlocking plate. As shown in FIG. 11, there are two cavities 18 at each end of a column of the MiC modules. A steel dowel bar 52 with enough anchorage length is provided in each cavity of the column.

Figure 12:
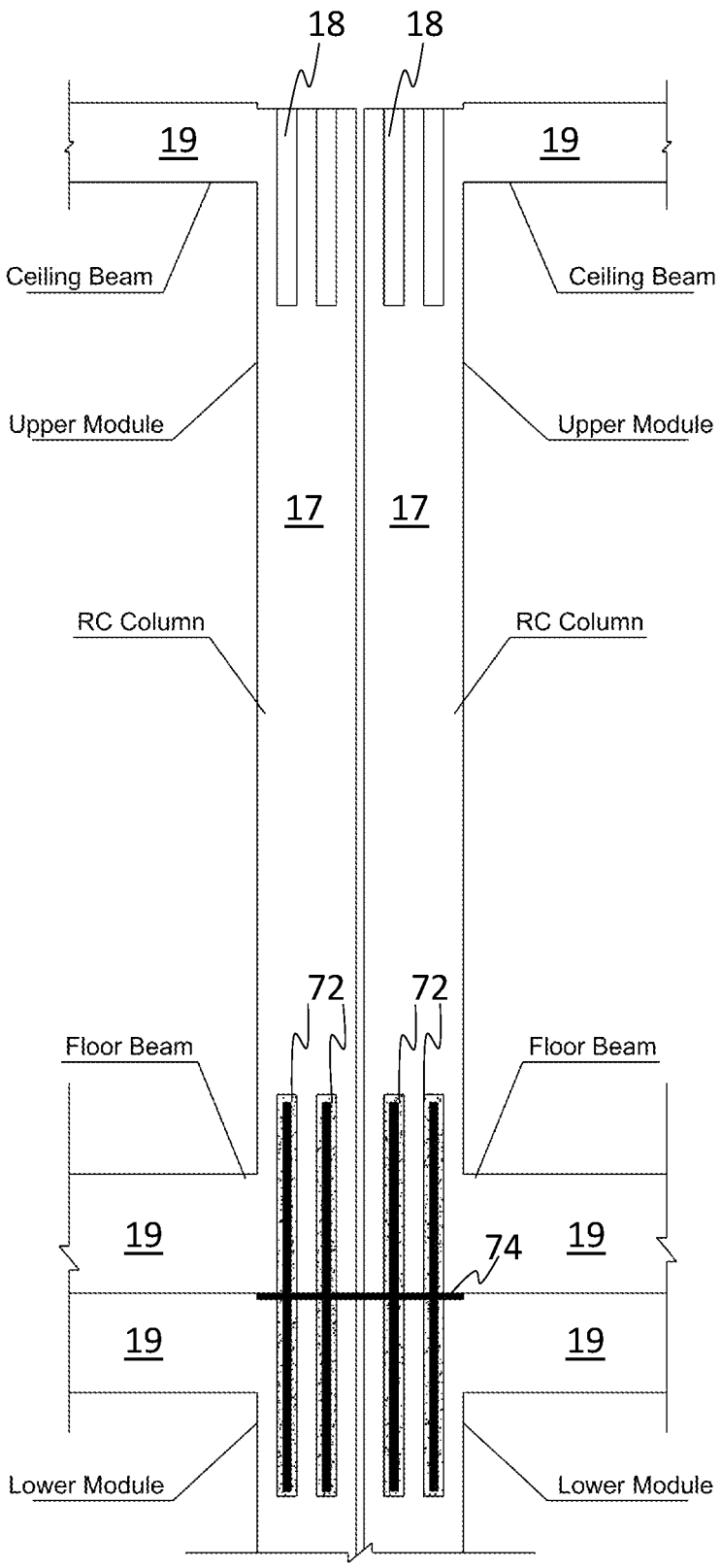
FIG. 12 is a section view of two L-shape columns connected together by an interlocking plate and grouted dowel bars in columns (two dowel bars in each of column)

FIG. 12 shows an enlarged section view of the connection joints of four MiC modules 10 connected together horizontally and vertically in accordance with an embodiment of the invention. Two vertical alignment connectors 72 which may be dowel bars 72 are provided in each column and are designed to bear tensile loads and transfer the tensile loads from the upper columns to the lower columns and finally down to a foundation of the building through a grouting. The horizontal load-distributing steel plate 74 with openings for the dowel bars 72 is provided to connect the MiC modules together horizontally and transfer loads among the modules.

Figure 13:
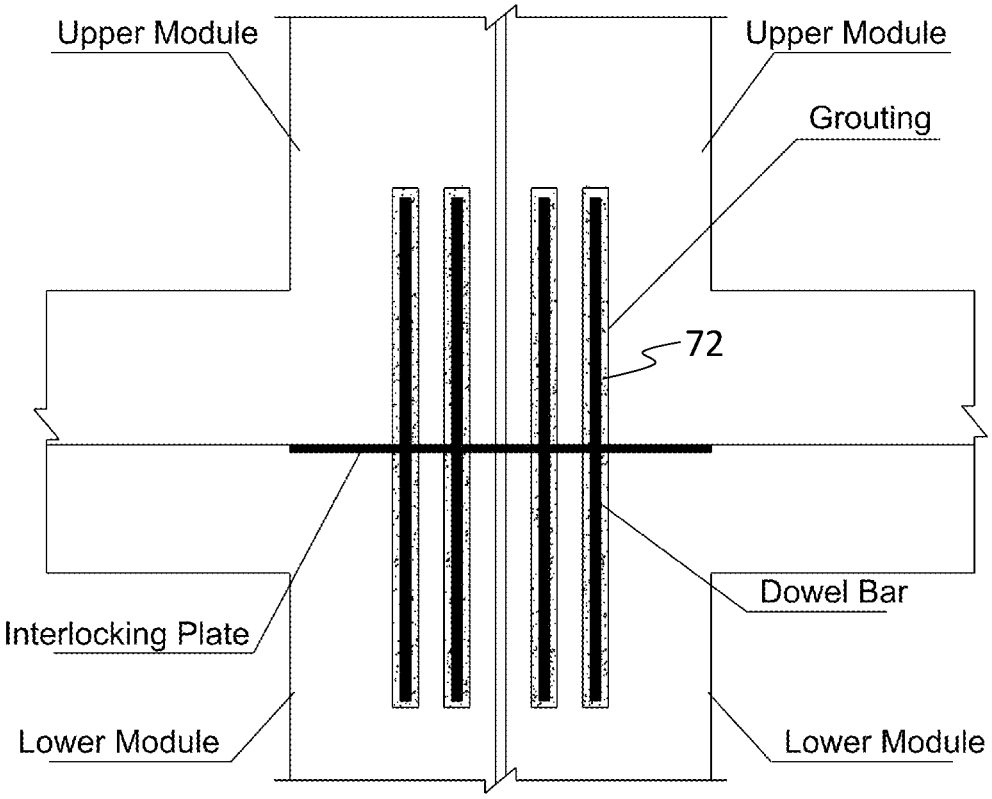
FIG. 13 is an enlarged section view of two L-shape columns connected together by an interlocking plate and grouted dowel bars in columns (two dowel bars in each of column)

FIG. 13 shows an enlarged section view of the connection joints of four MiC modules connected together horizontally and vertically in accordance with an embodiment of the invention. Two dowel bars are provided in each column and are designed to take tensile loads and transfer the tensile loads from the upper columns to the lower columns and finally down to a foundation of the building through a grouting. A horizontal load-distributing steel plate with openings for the dowel bars is provided to connect the MiC modules together horizontally.

Figure 14:
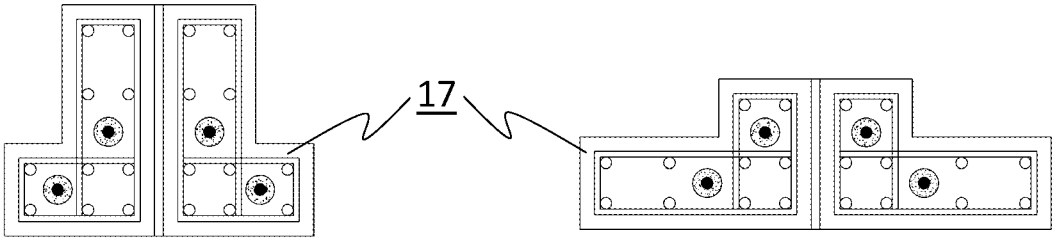
FIG. 14 is a plan view of two L-shape columns connected together by an interlocking plate and grouted dowel bars in columns (two dowel bars in each of column)

FIG. 14 shows the plan views of two L-shape reinforced concrete columns 17 connected together with two grouted vertical connecting dowel bars in each column and a rectangular interlocking plate for two different arrangements of the column layout. The thickness of the horizontal load-distributing steel plate can be varied to suit for the variation in height due to the fabrication error and installation tolerance. The diameter of the cavity provided in a column is preferred at least 3 times of that of the dowel bar to ensure the quality of a grouting after the dowel bars are positioned. To ensure the horizontal structural continuity, the diameter of the dowel bars is preferably no more than 2 mm smaller that the inner face of the circular openings of the interlocking plate. The longitudinal reinforcement and shear links shown in FIG. 13 are indicative and for reference only. They can be arranged according to actual design of the columns in a practical project.

Figure 15:
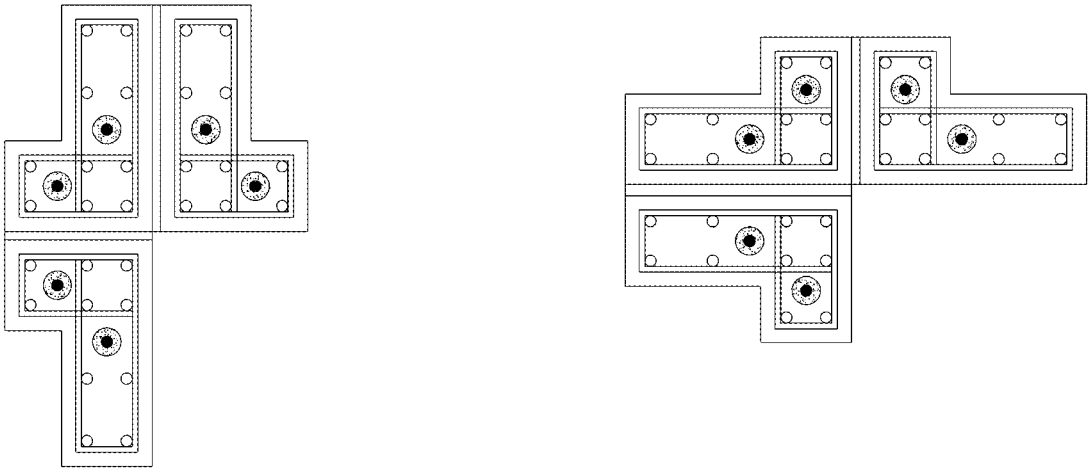
FIG. 15 is a plan view of three L-shape columns connected together by an interlocking plate and grouted dowel bars in columns (two dowel bars in each of column)
Figure 16:
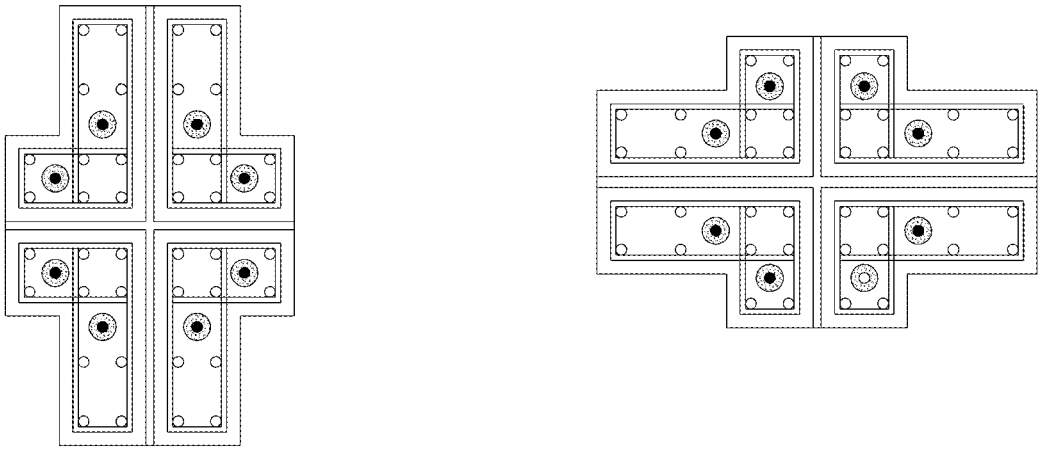
FIG. 16 is a plan view of four L-shape columns connected together by an interlocking plate and grouted dowel bars in columns (two dowel bars in each of column)
Figure 17:
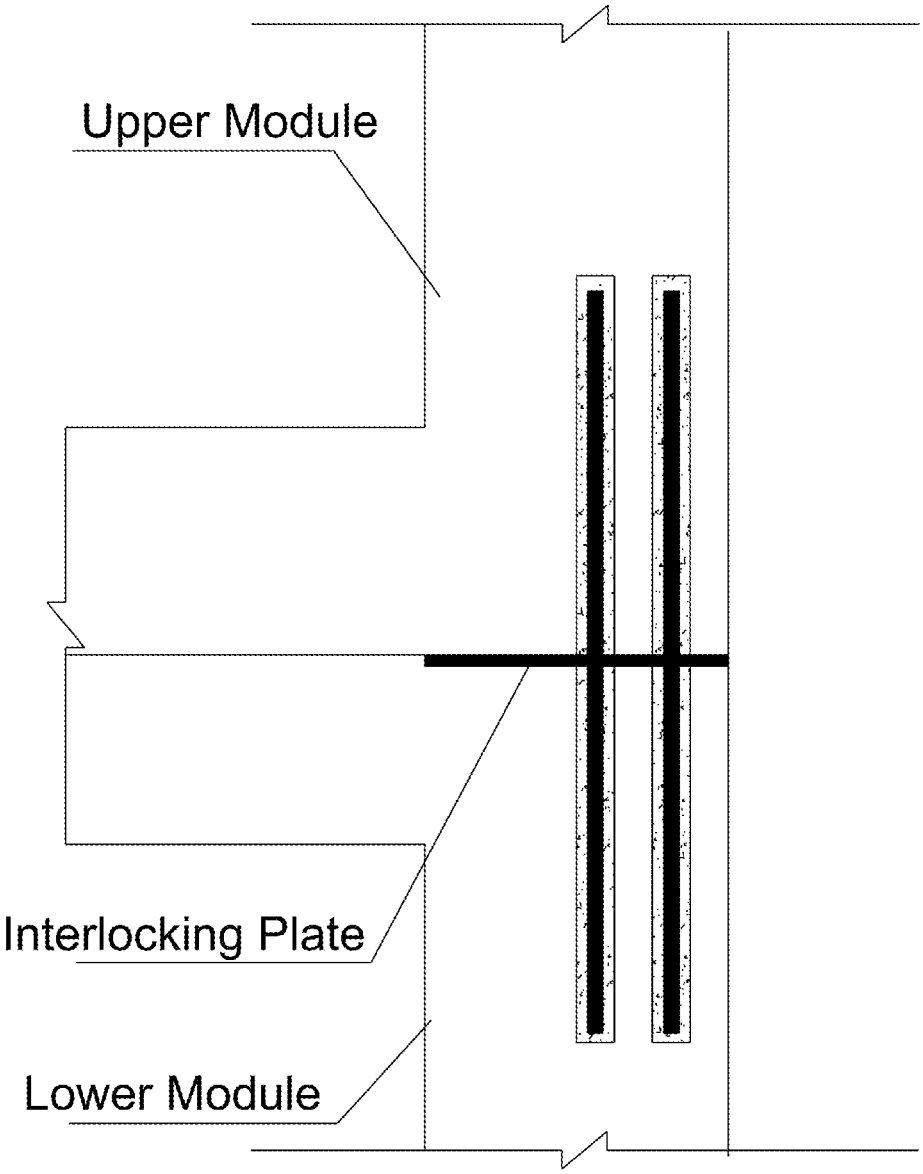
FIG. 17 is an elevation view of corner L-shape columns connected together by an interlocking plate and grouted dowel bars in columns (two dowel bars in each of column)

FIGS. 15, 16 and 17 show the alternative embodiments of the aforementioned connection joints with the following configurations:

The connection system shown in FIG. 15 for use with three MiC modules connected together horizontally;

The connection system shown in FIG. 16 for use with four MiC modules connected together horizontally;

The connection system shown in FIG. 17 for use with one MiC modules connected together with an upper module vertically.

The foregoing description of the present invention has been provided for the purposes of illustration and description. It is not intended to be exhaustive or to limit the invention to the precise forms disclosed. Many modifications and variations will be apparent to the practitioner skilled in the art.

While the present disclosure has been described and illustrated with reference to specific embodiments thereof, these descriptions and illustrations are not limiting. It should be understood by those skilled in the art that various changes may be made and equivalents may be substituted without departing from the true spirit and scope of the present disclosure as defined by the appended claims. The illustrations may not necessarily be drawn to scale. There may be distinctions between the artistic renditions in the present disclosure and the actual apparatus due to manufacturing processes and tolerances. There may be other embodiments of the present disclosure which are not specifically illustrated. The specification and the drawings are to be regarded as illustrative rather than restrictive. Modifications may be made to adapt a particular situation, material, composition of matter, method, or process to the objective, spirit and scope of the present disclosure. All such modifications are intended to be within the scope of the claims appended hereto. While the methods disclosed herein have been described with reference to particular operations performed in a particular order, it will be understood that these operations may be combined, sub-divided, or re-ordered to form an equivalent method without departing from the teachings of the present disclosure. Accordingly, unless specifically indicated herein, the order and grouping of the operations are not limitations.

The invention claimed is:

1. A multi-storey modular building comprising a plurality of concrete-based prefabricated modules, the building comprising:

a first lightweight concrete-based prefabricated module having at least four concrete load-bearing elements including at least one beam and at least one column, and at least one horizontal structure selected from a ceiling or a floor that is at least partially attached to two or more of the load-bearing elements and the at least one column having a grout-accepting cavity at a top end thereof;

a second lightweight concrete-based prefabricated module having at least four concrete load-bearing elements including at least one beam and at least one column and at least one horizontal structure selected from a ceiling or a floor that is at least partially attached to two or more of the load-bearing elements, the at least one column having a grout-accepting cavity at a bottom end thereof;

the second lightweight concrete-based prefabricated module being positioned above the first lightweight concrete-based prefabricated module;

a connection system connecting the first lightweight concrete-based prefabricated module and the second concrete-based prefabricated module, the connection system comprising:

at least one vertical alignment connector attached to a horizontal load-distributing plate, a top portion of the vertical alignment connector positioned in the grout accepting cavity in the bottom end of the column of the second lightweight concrete-based prefabricated module and in the top end of the column of the first lightweight concrete-based prefabricated module;

the horizontal load-distributing plate positioned between the first and second lightweight concrete-based prefabricated modules; and in-situ grout embedding the vertical alignment connector in each grout accepting cavity.

2. The multi-storey modular building of claim 1, wherein a single horizontal load-distributing plate is attached with two vertical alignment connectors for connecting four lightweight concrete-based prefabricated modules of the multi-storey modular building.

3. The multi-storey modular building of claim 2, wherein two of the four lightweight concrete-based prefabricated modules are upper lightweight concrete-based prefabricated modules and the other two of the four lightweight concrete-based prefabricated modules are lower lightweight concrete-based prefabricated modules, and wherein each of the upper and lower lightweight concrete-based prefabricated modules is positioned adjacent to the other of the upper and lower lightweight concrete-based prefabricated modules, respectively.

4. The multi-storey modular building of claim 1, wherein a single horizontal load-distributing plate is attached with four vertical alignment connectors for connecting eight lightweight concrete-based prefabricated modules of the multi-storey modular building.

5. The multi-storey modular building of claim 4, wherein four of the eight lightweight concrete-based prefabricated modules are upper lightweight concrete-based prefabricated modules and the other four of the eight lightweight concrete-based prefabricated modules are lower lightweight concrete-based prefabricated modules, and wherein each of the upper and lower lightweight concrete-based prefabricated modules is positioned adjacent to each of the other three upper and each of the other three lower lightweight concrete-based prefabricated modules, respectively.

6. The multi-storey modular building of claim 1, wherein each of the vertical alignment connectors is a steel bar and the horizontal load-distributing plate is a steel plate.

7. The multi-storey modular building of claim 6, wherein one or more of the steel bars is/are permanently affixed to the steel plate through welding or through mechanical connectors.

8. The multi-storey modular building of claim 7, wherein the mechanical connectors are composed of a threaded portion on the one or more steel bars and a corresponding threaded aperture in the steel plate for receiving the threaded portion of the steel bars.

9. The multi-storey modular building of claim 1, wherein each of the upper lightweight concrete-based prefabricated modules comprises at least one grouting channel that leads to an upper portion of the grout accepting cavity for grouting to embed the vertical alignment connector in said grout accepting cavity.

10. A method of assembling a multi-storey modular building comprising a plurality of concrete-based prefabricated modules, the method comprising:

positioning a first lightweight concrete-based prefabricated module on a first level, the module having at least four concrete load-bearing elements including at least one beam and at least one column, and at least one horizontal structure selected from a ceiling or a floor that is at least partially attached to two or more of the load-bearing elements and the at least one column having a grout-accepting cavity at a top end thereof;

applying grout to the grout-accepting cavity;

positioning a vertical alignment connector attached to a horizontal load-distributing plate on the first module such that bottom portion of the vertical alignment connector is positioned in the grout accepting cavity in the top end of the column of the first lightweight concrete-based prefabricated module with the horizontal load-distributing plate positioned on the top end of the column of the first lightweight concrete-based prefabricated module;

positioning a second lightweight concrete-based prefabricated module over the first lightweight concrete-based prefabricated module, the second lightweight concrete-based prefabricated module having at least four concrete load-bearing elements including at least one beam and at least one column and at least one horizontal structure selected from a ceiling or a floor that is at least partially attached to two or more of the load-bearing elements, the at least one column having a grout-accepting cavity at a bottom end thereof;

the second lightweight concrete-based prefabricated module being positioned such that a top end of the vertical alignment connector is inserted into the grout-accepting cavity at the bottom end of the at least one column and the horizontal load-distributing plate is positioned between the first and second lightweight concrete-based prefabricated modules.

* * * * *